US010968544B2

(12) United States Patent
Debnath et al.

(10) Patent No.: US 10,968,544 B2
(45) Date of Patent: Apr. 6, 2021

(54) PROCESS FOR MANUFACTURING AIR RICH YARN AND AIR RICH FABRIC

(71) Applicant: Trident Limited, Ludhiana (IN)

(72) Inventors: Pradip Debnath, Barnala (IN); Swadesh Verma, Barnala (IN)

(73) Assignee: Trident Limited

( * ) Notice: Subject to any disclaimer, the term of this patent is extended or adjusted under 35 U.S.C. 154(b) by 138 days.

(21) Appl. No.: 16/235,216

(22) Filed: Dec. 28, 2018

(65) Prior Publication Data

US 2019/0186054 A1 Jun. 20, 2019

Related U.S. Application Data

(63) Continuation-in-part of application No. 13/242,409, filed on Sep. 23, 2011, now Pat. No. 10,196,763.

(30) Foreign Application Priority Data

Sep. 24, 2010 (IN) ..... 1867/DEL/2010

(51) Int. Cl.
*D02G 3/04* (2006.01)
*D03D 15/00* (2021.01)
(Continued)

(52) U.S. Cl.
CPC ..... *D02G 3/04* (2013.01); *D02G 3/406* (2013.01); *D03D 15/00* (2013.01); *D03D 27/08* (2013.01);
(Continued)

(58) Field of Classification Search
CPC ..... D02G 3/04; D02G 3/406; D03D 15/00; D03D 27/08; D10B 2321/06; D10B 2201/02
See application file for complete search history.

(56) References Cited

U.S. PATENT DOCUMENTS 4,164,603 A 8/1979 Siggel et al.
4,544,594 A 10/1985 Li et al.
(Continued)

FOREIGN PATENT DOCUMENTS

EP 2172583 A1 4/2010
JP 5117966 A 5/1993
(Continued)

OTHER PUBLICATIONS

Havis, Simon, "Wool/PVA Fiber Production Technology." Crimp Wool and Technology, Feb. 1997, pp. 1-50, No. 77, XP-002636820.
European Search Report for EP 11 18 2724, dated Feb. 16, 2012.

*Primary Examiner* — Shaun R Hurley
(74) *Attorney, Agent, or Firm* — Lerner, David, Littenberg, Krumholz & Mentlik, LLP

(57) ABSTRACT

A process for manufacturing air-rich yarn and air-rich fabric is provided. The process of the present invention uses optimized parameters for blending, doubling, drafting and spinning in draw frame, roving frame and ring frame respectively. The process of the present invention provides an air rich yarn comprising a plurality of fibers of a water soluble material interlinked and distributed homogenously across a cross-section of the yarn using the optimized parameters. The plurality of fibers of water soluble material after treatment with water provides an improved air rich yarn comprising a plurality of interlinked through-pores distributed homogenously across the cross-section of the yarn. Further, the present invention provides a process of preparing an air-rich fabric from the air-rich yarn, where the fabric exhibits high wettability, easy dry ability, quick absorbency and increased thickness due to homogenous distribution of the plurality of interlinked through-pores across the cross-section of the yarn.

28 Claims, 5 Drawing Sheets

Normal cotton yarn Structure

Earlier PVA based yarns – "hollow from the centre"

Air Rich yarn --" homogeneous porous structure

(51) Int. Cl.
*D03D 27/08* (2006.01)
*D02G 3/40* (2006.01)

(52) U.S. Cl.
CPC ..... *D10B 2201/02* (2013.01); *D10B 2321/06* (2013.01)

(56) References Cited

U.S. PATENT DOCUMENTS 5,577,307 A 11/1996 Itoi
8,733,075 B2 * 5/2014 Mandawewala ..... D03D 27/00 57/5
9,677,202 B2 * 6/2017 Mandawewala ..... D02G 3/44
2002/0133924 A1 * 9/2002 Cohen ..... D03D 15/0027 28/168
2002/0150756 A1 10/2002 Tanaka et al.
2004/0131821 A1 7/2004 Mandawewala
2005/0102992 A1 5/2005 Yanagihara et al.
2007/0087162 A1 4/2007 Mandawewala
2007/0214765 A1 * 9/2007 Teshima ..... D02G 3/406 57/293
2008/0083047 A1 4/2008 Prickett
2009/0078330 A1 * 3/2009 Wang ..... D06P 1/67333 139/25
2009/0235498 A1 * 9/2009 Sun ..... D06P 3/66 28/179
2010/0300576 A1 12/2010 Liu et al.
2012/0076971 A1 * 3/2012 Debnath ..... D02G 3/406 428/85
2013/0037163 A1 * 2/2013 Teshima ..... D02J 1/02 139/391
2017/0370029 A1 * 12/2017 Wang ..... D02G 3/406

FOREIGN PATENT DOCUMENTS

WO 2008154866 A1 12/2008
WO 2009098583 A1 8/2009

* cited by examiner

Normal cotton yarn Structure

Earlier PVA based yarns – “hollow from the centre”

Air Rich yarn --" homogeneous porous structure

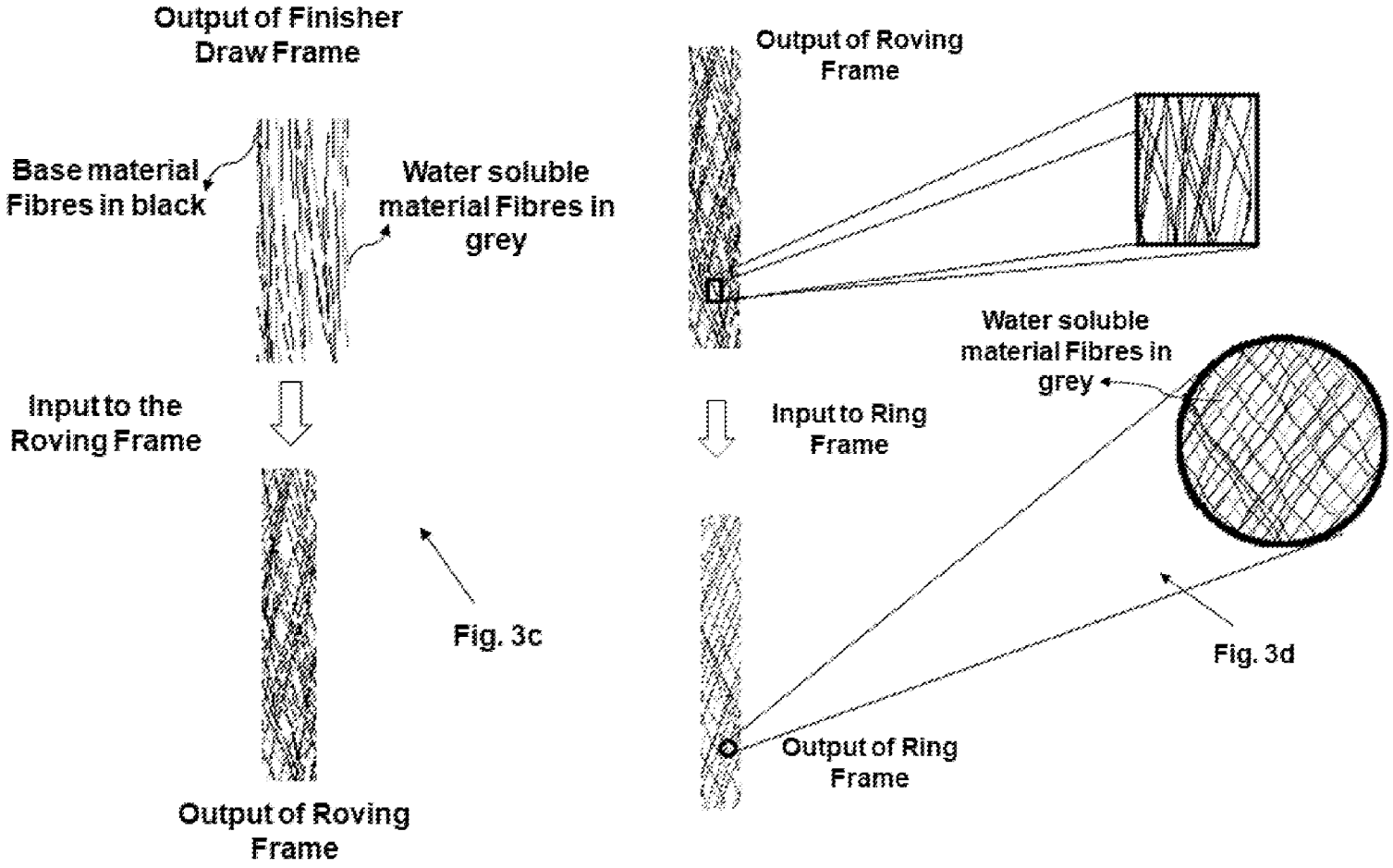
Cont. Fig. 3

PROCESS FOR MANUFACTURING AIR RICH YARN AND AIR RICH FABRIC

CROSS-REFERENCE TO RELATED APPLICATIONS

This application is a continuation in part of U.S. application Ser. No. 13/242,409 filed on Sep. 23, 2011, which claims the benefit of priority to Indian Patent Application No. 1867/DEL/2010, filed on Sep. 24, 2010, the disclosure of which is hereby expressly incorporated in parts.

FIELD OF THE INVENTION

The present invention relates to textile manufacturing and more particularly to an improved process for manufacturing air-rich yarn and air-rich fabric exhibiting high wettability, easy dry ability, quick absorbency and increased thickness.

BACKGROUND OF THE INVENTION

Fabric is a flexible material comprising a network of natural and/or artificial fibers often referred to as yarn or thread. A yarn is produced by spinning raw fibers such as wool, linen, cotton, or other natural or manmade material on a spinning wheel. A thread is produced by twisting two or more yarns together. Further, fabrics may be classified into three categories woven, knitted and non-woven fabrics. Fabrics may be further classified into terry fabric and flat fabrics. Terry woven fabrics, also known as, towelling fabrics may be made from 100% cotton fiber yarns, yarns made from fiber blends such as cotton and viscose, blends of cotton and modal, blends of silk and modal, bamboo fiber yarns; and blends of cotton and bamboo yarns. Flat fabrics, such as sheeting or apparel, may be made from 100% cotton, blends of polyester and cotton, blends of polyester and viscose, blends of cotton and modal, blends of cotton, silk and modal; and any combinations thereof. Additionally, decorative designs and embellishments may be formed using polyester filament, polyester spun yarn, viscose filament yarn, viscose spun yarn, mercerized cotton yarn, cotton linen fiber blended yarns, Ramie cotton fiber blended yarn, modal fiber yarns, chenille yarn, modified viscose fiber yarn, and combinations thereof. Terry fabrics are generally thick and absorb greater amount of water, as thicker the towelling fabric, greater the surface area. Terry fabrics generally include a plurality of pile loops, where the plurality of pile loops when exposed to a water droplet remove the droplet first by sucking the droplet between the spaces available between the pile loops and then absorb the water inside the yarn in the space between the fibers in the yarn. The latter part applies to flat fabrics as well. The absorbed water then enters the secondary wall and in a lumen of the cotton fiber.

Furthermore, terry products generally include a low-twist pile yarn, a ground warp yarn and a weft yarn. Pile yarn loops in the terry fabrics provide maximum surface area for the absorption of water and low twist aids in the absorption by imparting wicking properties to the yarn. Ground warp and weft yarns are generally hard-twisted compared to the pile yarn. The ground warp and weft yarn twist factors generally range from about 3.8 to about 4.2, depending upon the towel construction. In contrast, the twist factor in the pile yarn generally ranges from about 3.2 to about 3.9. Similarly in case of flat fabrics the twist factor for warp yarns and weft yarns ranges from 3.8 to 4.5. The yarns used in terry fabrics are generally coarse and range from 8 Ne to 30 Ne in single as well as doubled configuration for pile, weft and ground yarns. Similarly the warp and weft yarn count, in flat fabrics range from 12 Ne to 100 Ne in single as well as doubled configuration depending on the construction of fiber, their blends and the structure of the yarn made thereof.

Conventional techniques provide free spaces within the structure of yarn by using Polyvinyl alcohol ("PVA"), a man-made fiber, exhibiting unique property of dissolving in hot water by introducing PVA into blended yarns, for instance in core of a cotton yarn.

The conventional techniques introduces PVA into cotton yarn via cotton spinning system using the methods as listed below:

a) Inserting PVA fibers into the core during ring spinning, by inserting PVA spun yarn into the stream of cotton fibers in the drafting zone during ring spinning on Ring Frame.
b) Blending the PVA roving with the cotton roving during feeding in the drafting system of ring frame in SIRO spinning system.
c) Inserting PVA fiber slivers into the middle of cotton slivers at the feeding end of the drafting zone of the speed frame, twisting on the speed frame, and subsequently spinning the yarn at ring frame.
d) Blending PVA fiber along with cotton fiber in the initial process of fiber mixing in cotton spinning system.
e) Doubling PVA yarn with cotton yarn with twist in reverse direction of cotton yarn leaving the final finished fabric with cotton yarn having only few turns of twist.

However, methods (a), (b) and (c) do not ascertain blend homogeneity across radial direction in the final yarn structure. The pores formed are mainly of 'closed' and 'blind' type. The yarn made by said methods may be hollow in the core but the surface is covered. Covered surface does not allow easy access of water into the core in hollow space. Therefore, said methods are not effective to attain a porous yarn structure in the final fabric. The difference in structure of yarns manufactured by using any of the methods (a), (b) and (c) and structure of yarn manufactured using the process of the present invention can be well understood from schematic diagram in FIG. 1.

By using process (d) porous yarn structure in the final fabric can be attained. However, this process has operational challenges in blending process due to entirely different properties and processing behavior of PVA fibers.

Process (e) involves separate spinning process for PVA yarn and Cotton Yarn. Therefore, an additional cost of doubling process with PVA yarn is added, making the process expensive. Also, structure of the yarn is open fiber structure which causes negligible binding of the fibers. Further, none of the methods (a), (b), (c), (d) and (e) provide interlinked 'through-pores' throughout the cross section of the yarn.

In light of the aforementioned drawbacks, there is a need for a process for manufacturing a yarn and a fabric having a high percentage of pores throughout the cross-section of the yarn and fabric produced from the yarn. There is need for a process which provides a yarn and a fabric with enhanced bulk, high absorbency and durability. Furthermore, there is a need for an improved process which provides homogenous distribution of through-pores across the cross-section of the yarn, where through-pores are the pores which open to outside and permit fluid flow. Yet further, there is a need for an improved process which provides interlinking of through-pores in the yarn, such that the fabric manufactured from the yarn exhibits high wettability, easy dry ability, quick absorbency and increased thickness or bulk. Yet further, there is a need to provide a process which is cost effective and economical.

SUMMARY OF THE INVENTION

In various embodiments of the present invention a process for manufacturing a yarn comprising a plurality of interlinked through-pores distributed homogenously across a cross-section of the yarn is provided. The process comprises preparing a plurality of blended slivers, wherein each of the plurality of blended slivers are prepared by blending one or more slivers of a water soluble material with one or more slivers of a base material. The process further comprises doubling the plurality of blended slivers to obtain a homogenously blended sliver such that a plurality of fibers of the water soluble material in each of the one or more slivers of the water soluble material and a plurality of fibers of the base material in each of the one or more slivers of the base material distribute radially and homogenously across a cross-section of the homogenously blended sliver. Furthermore, the process comprises drafting the homogenously blended sliver to obtain a roving such that the plurality of fibers of the water soluble material and the plurality of fibers of the base material distribute radially and homogenously across a cross-section of the roving, wherein at least the plurality of fibers of the water soluble material are caused to be interlinked. Yet further, the process comprises spinning the roving such that the plurality of fibers of the water soluble material and the plurality of fibers of the base material interlink and distribute radially and homogenously across a cross-section of the spun yarn. Finally the water soluble material fibers are dissolved by treating with water to obtain the yarn comprising the plurality of interlinked through-pores distributed homogenously across the cross-section of the yarn.

In various embodiments of the present invention a process for manufacturing a yarn comprising a plurality of interlinked through-pores distributed homogenously across a cross-section of the yarn is provided. The process comprises preparing a plurality of blended slivers, where each of the plurality of blended slivers are prepared by blending one or more slivers of a water soluble material with one or more slivers of a base material using a first set of parameters for optimized blending. A cut length of staple water soluble fibers and staple base material fibers for preparing each sliver of water soluble material and each sliver of base material respectively, is substantially equal, such that the one or more fibers of the water soluble material extend longitudinally along a length of each of the plurality of blended slivers, respectively. The process further comprises doubling the plurality of blended slivers using a second set of parameters to obtain a homogenously blended sliver, such that a plurality of fibers of water soluble material included in each sliver of water soluble material of each of the plurality of blended slivers distribute radially and homogenously across a cross-section of the homogenously blended sliver. Furthermore, the process comprises drafting the homogenously blended sliver using a third set of parameters to obtain a roving. The third set of parameters facilitate the plurality of fibers of water soluble material to distribute radially and homogenously across a cross-section of the roving. Further, the third set of parameters cause a fraction of the plurality of fibers of water soluble material to interlink. Yet further, the method comprises spinning the roving using a fourth set of parameters to obtain a spun yarn having a twist multiplier in the range of 3.2 to 3.8. The fourth set of parameters facilitate the plurality of fibers of water soluble material to interlink and distribute radially and homogenously across a cross-section of the spun yarn. Finally the water soluble material is dissolved by treating the spun yarn with water to obtain the yarn comprising the plurality of interlinked through-pores distributed homogenously across the cross-section of the yarn.

In various embodiments of the present invention, a process for manufacturing a fabric comprising a plurality of interlinked through-pores distributed homogenously across a cross-section of a yarn is provided. The process comprises preparing a plurality of blended slivers. Each of the plurality of blended slivers are prepared by blending one or more slivers of a water soluble material with one or more slivers of a base material. Further, the process comprises doubling the plurality of blended slivers to obtain a homogenously blended sliver such that a plurality of fibers of water soluble material in each of the one or more slivers of the water soluble material and a plurality of fibers of base material in each of the one or more slivers of the base material distribute radially and homogenously across a cross-section of the homogenously blended sliver. Furthermore, the process comprises drafting the homogenously blended sliver to obtain a roving such that the plurality of fibers of the water soluble material and the plurality of fibers of the base material distribute radially and homogenously across a cross-section of the roving, where at least the plurality of fibers of the water soluble material are caused to be interlinked. Yet further, the process comprises spinning the roving such that the plurality of fibers of the water soluble material and the plurality of fibers of the base material interlink and distribute radially and homogenously across a cross-section of the spun yarn. Yet further, the process comprises preparing a fabric using the spun yarn as at least one component. Finally, the process comprises processing the prepared fabric, wherein processing includes treatment with water and dyeing, wherein further treatment with water and dyeing dissolves the water soluble material in the spun yarn to provide the plurality of interlinked through-pores distributed homogenously across the cross-section of the spun yarn.

In various embodiments of the present invention, a process for manufacturing a fabric comprising a plurality of interlinked through-pores distributed homogenously across a cross-section of a yarn is provided. The process comprises preparing the plurality of blended slivers. Each of the plurality of blended slivers are prepared by blending one or more slivers of the water soluble material with one or more slivers of the base material using a first set of parameters for optimized blending. A cut length of staple water soluble fibers and staple base material fibers for preparing each sliver of water soluble material and each sliver of base material respectively, is substantially equal, such that the one or more fibers of the water soluble material extend longitudinally along a length of each of the plurality of blended slivers, respectively. Further, the process comprises doubling the plurality of blended slivers using a second set of parameters to obtain the homogenously blended sliver such that the plurality of fibers of the water soluble material included in each of the one or more slivers of the water soluble material distribute radially and homogenously across a cross-section of the homogenously blended sliver. Furthermore, the process comprises drafting the homogenously blended sliver using a third set of parameters to obtain the roving. The third set of parameters facilitate the plurality of fibers of water soluble material to distribute radially and homogenously across a cross-section of the roving. The third set of parameters further causes at least a fraction of the plurality of fibers of water soluble material to interlink. Yet further, the process comprises spinning the roving using a fourth set of parameters to obtain the spun yarn having a twist multiplier in the range of 3.2 to 3.8. The fourth set of parameters cause the plurality of fibers of the water soluble material to interlink and distribute radially and homogenously across a cross-section of the spun yarn. Yet further, the process comprises preparing the fabric using the spun yarn as at least one component. Finally the process comprises processing the prepared fabric, where processing includes treatment with water and dyeing. Additionally, treatment with water and dyeing dissolves the water soluble material in the spun yarn to provide the plurality of interlinked through-pores distributed homogenously across the cross-section of the spun yarn.

BRIEF DESCRIPTION OF DRAWINGS

These and other features, aspects, and advantages of the present invention will become better understood when the following detailed description is read with reference to the accompanying drawings, wherein.

DETAILED DESCRIPTION OF THE INVENTION

Figure 1:
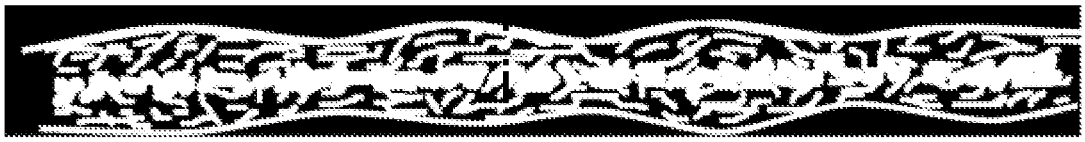
FIG. 1 illustrates a prior art structure of a core based PVA yarn and structure of an Air Rich yarn manufactured by the improved process, in accordance with various embodiments of the present invention.
Figure 1:
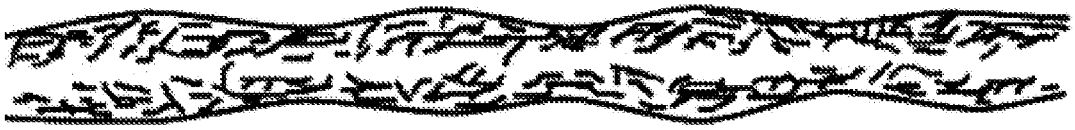
Figure 1:
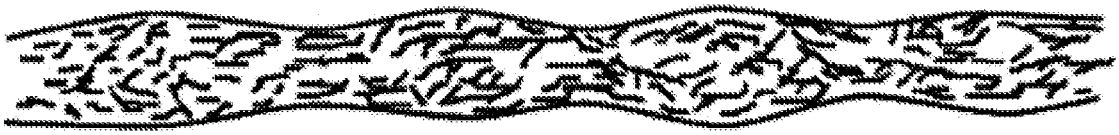

The present invention provides an improved process for manufacturing an air rich yarn and an air-rich fabric. The process of the present invention uses optimized parameters for blending, doubling, drafting and spinning in draw frame, roving frame and ring frame respectively. In particular, the process of the present invention using the optimized parameters provides an air rich yarn comprising a plurality of fibers of a water soluble material interlinked and distributed homogenously across a cross-section of the yarn. The plurality of fibers of water soluble material after treatment with water provides an improved air rich yarn comprising a plurality of interlinked through-pores distributed homogenously across the cross-section of the yarn. Further, the present invention provides a process of preparing an air-rich fabric from the air-rich yarn. The air rich fabric exhibits high wettability, easy dry ability, quick absorbency and increased thickness due to homogenous distribution of the plurality of interlinked through-pores across the cross-section of the yarn.

Exemplary embodiments herein are provided only for illustrative purposes and various modifications will be readily apparent to persons skilled in the art. The general principles defined herein may be applied to other embodiments and applications without departing from the spirit and scope of the invention. The terminology and phraseology used herein is for the purpose of describing exemplary embodiments and should not be considered limiting. Thus, the present invention is to be accorded the widest scope encompassing numerous alternatives, modifications and equivalents consistent with the principles and features disclosed herein. For purposes of clarity, details relating to technical material that is known in the technical fields related to the invention have been briefly described or omitted so as not to unnecessarily obscure the present invention.

It is to be noted that, as used in the specification by the term "substantially" it is meant that the recited characteristic, parameter, or value need not be achieved exactly, but that deviations or variations, including for example, tolerances, measurement error, measurement accuracy limitations and other factors known to those skilled in the art, may occur in amounts that do not preclude the effect the characteristic was intended to provide. Additionally, definitions of a few terms as used in the specification are provided below for ease of understanding.

English count (Ne)": Number of hanks of 840 yards per pound.

Hank: Mass per unit length of sliver (measure of linear mass density of sliver). A hank of wool is 560 yards, cotton and silk is 840 yards, and linen is 300 yards.

Absorbency—The propensity of a material to take in and retain liquid, generally water.

Blend—A textile containing two or more different fibers, variants of the same fiber or different colors and grades of the same fiber.

Blending—The mixing of quantities of the same fiber taken from many lots or of different types of fiber to produce a uniform result.

Carding—A process in manufacturing spun yarn in which the fibers are separated, distributed, equalized and formed into a web. The web can be very thin or thick. The process of carding removes some impurities, and a certain amount of short or broken fibers.

Doubling: The process of combing two or more carded sliver into a single form is called doubling.

Spinning: The final step in the production of yarn. The twisting of fibers in the form of the sliver or roving.

Core Spinning—A yarn spinning process using which a filament (usually elastic under tension) is covered with a sheath of staple fibers to produce stretchable yarn. The resultant yarn and fabric have the characteristics of the sheath fiber along with the advantage of stretch and recovery.

Core Yarn: A yarn made by winding one yarn/fiber around another to give the appearance of a yarn made solely of the outer yarn.

Denier: Refers to the thickness of a fiber. It is the measurement of the diameter of the fiber and refers to weight in grams for 9000 meters.

Pile: A surface effect on a fabric formed by tufts or loops of yarn that stand up from the body of the fabric such as terry towel fabric.

Warp: In woven fabric, the yarns that run lengthwise and are interwoven with the fill (weft) yarns.

Weft: In woven fabric, the filling yarns that runs perpendicular to the warp yarns.

Yarn: A continuous strand of textile fibers created when a cluster of individual fibers are twisted around one another.

Base material: refers to cotton, cotton blends, silk, modal fibers, acrylic, blends of cotton and bamboo, blends of cotton and sea weeds, blends of cotton and silver, blends of cotton and charcoal, blends of polyester and cotton, blends of polyester and viscose, blends of cotton and modal and combinations thereof.

Water soluble material: material having unique property of dissolving in hot water, polyvinyl alcohol ("PVA"), a man-made fiber.

PVA: A synthetic polymer available in the form of filaments and cut fibers. PVA fibers are easily dissolved in warm or hot water at about 40 degree Celsius to 110 degree Celsius without the aid of any chemical agents.

Sliver: It is a continuous strand of loosely assembled fibers without twist. The production of the sliver is the first step in the textile operation that brings the staple fiber into a form that can be drawn and eventually twisted into a spun yarn.

Porosity: Porosity is the ratio of the volume of openings (voids) to the total volume of material. Porous surface of the yarn having more air gaps in the yarn structure provide quick absorption and early shedding of water that is being absorbed.

Through-pores: Open to outside surface and permit fluid flows

Thermal Insulation: It is a measure of amount of heat a fabric can resist from its surface to dissipate in to the atmosphere Wettability: Wettability or wetting is the actual process when a liquid spreads on a solid substrate or material. It can be estimated by determining the contact angle or calculating area of spreading or time taken to spread.

The present invention would now be discussed in context of embodiments as illustrated in the accompanying drawings.

Figure 2:
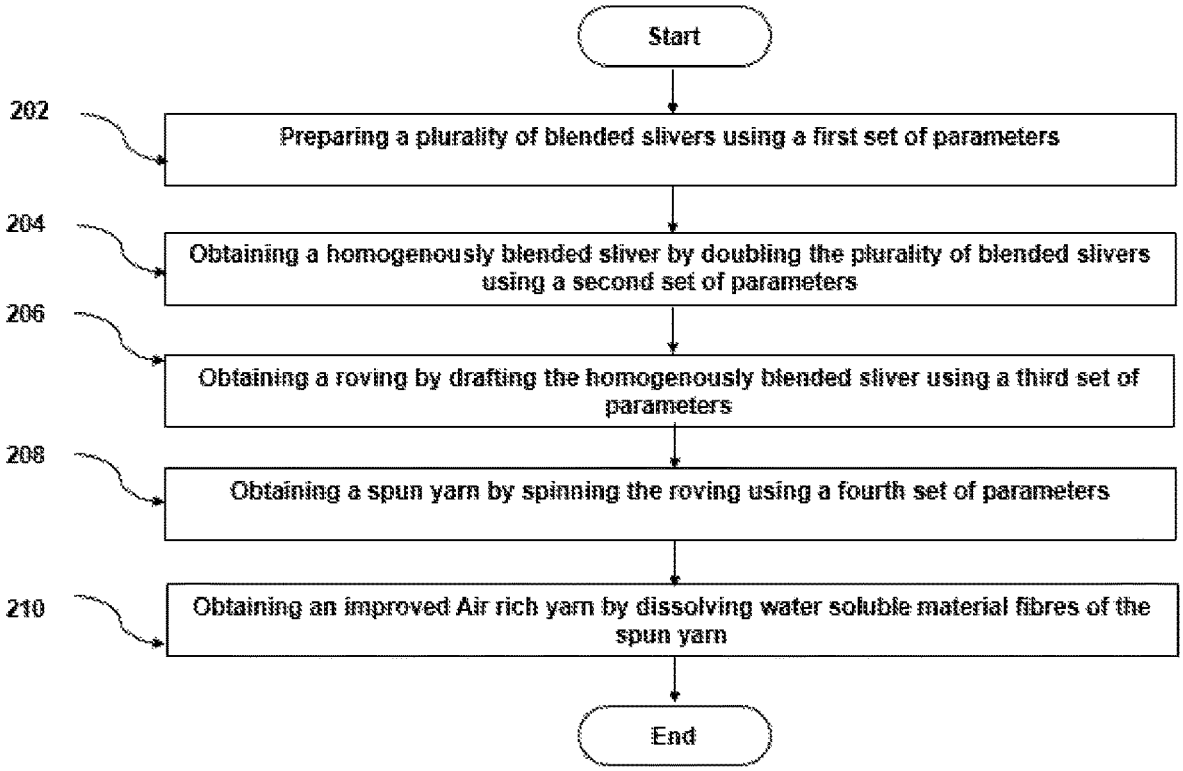
FIG. 2 is a flow chart illustrating an improved process for manufacturing an Air Rich yarn comprising a plurality of interlinked through-pores distributed homogenously across a cross-section of the yarn, in accordance with various embodiments of the present invention.

FIG. 2 is a flow chart illustrating an improved process for manufacturing an Air Rich Yarn comprising a plurality of interlinked through-pores distributed homogenously across a cross-section of a yarn, in accordance with various embodiments of the present invention.

At step 202, a plurality of blended slivers are prepared using a first set of parameters. In various embodiments of the present invention, each of the plurality of blended slivers are prepared by blending one or more slivers of a water soluble material with one or more slivers of base material using a first set of parameters for optimized blending. In particular, each of the one or more slivers of water soluble material are prepared from a plurality of staple fibers of the water soluble material. In an exemplary embodiment of the present invention, the water soluble material is polyvinyl alcohol (PVA). In another embodiment of the present invention, each of the one or more slivers of water soluble material may be prepared from a blend comprising water soluble fibers along with a small percentage of base material fiber. Examples of the base material fiber may include, but are not limited to, raw fiber with impurities or processed clean fiber such as reusable waste, carded or combed sliver. In an exemplary embodiment of the present invention, 10% of base material fiber is mixed with the water soluble material fibers. In yet another exemplary embodiment of the present invention, 1-50% base material fiber may be mixed with the water soluble material fibers. In operation, in an exemplary embodiment of the present invention, PVA fibers may be selected for the preparation of each of the plurality of water soluble material slivers. A plurality of PVA fibers are processed in a blow room system or a draw frame. In particular, the plurality of PVA fibers are opened, cleaned, carded, blended and leveled to obtain each sliver of the water soluble material. In an exemplary embodiment of the present invention, the linear mass density of each of the water soluble material fibers is typically in the range of 1.2 to 2.2 denier (D). In an exemplary embodiment of the present invention, the cut length of each of the water soluble material fibers is in the range of 30 mm to 38 mm. In a preferred embodiment of the present invention, the cut length of each of the water soluble material fiber is 32 mm.

In a preferred embodiment of the present invention, the properties of PVA fiber selected for the preparation of each of the plurality of water soluble material slivers are reproduced in Table 1 below:

| S. No. | Nominal Dissolving Temp in Water(Lowest Temp)(degree Celsius) | Fineness (dtex) 1 dtex = 0.9 D | Fiber Cut length |
|---|---|---|---|
| 1 | 40 | 1.2 | 38 |
| | | 1.7 | 38 |
| | | 2.2 | 38 |
| 2 | 50 | 1.7 | 32, 38 |
| | | 2.2 | 32, 38, |
| 3 | 70 | 1.7 | 38 |
| 4 | 80/90 | 1.4 | 32, 38 |
| | | 1.7 | 32, 38 |
| 5 | 95 | 1.7 | 38 |

In an embodiment of the present invention, the linear density of water soluble material sliver obtained from the water soluble material fibers ranges from 0.05 to 0.15 hank. In an exemplary embodiment of the present invention, a finer sliver of the water soluble material having a linear density greater than or equal to 0.11 hank may be produced on the draw frame.

Further, each of the one or more slivers of base material are prepared from a plurality of staple fibers of the base material. In an embodiment of the present invention, the base material may be selected from various cotton blends, greige cotton, dyed cotton, cleaned cotton, colored cotton, silk fibers, modal fibers, lyocell (Tencel), greige or dyed acrylic fibers, greige or dyed polyester, polybutylene terephthalate (PBT), recycled polyester, polytrimethylene terephthalate (PTT), any other cellulose based stable fiber, blends of cotton and bamboo, blends of cotton and sea weed fibers, blends of cotton and lyocell fibers, and blends of cotton and charcoal fibers. In operation, in an exemplary embodiment of the present invention, cotton fibers are selected for preparation of each of the plurality of the base material slivers. The plurality of base material fibers are processed in a blow room system. The processed fibers of the base material are carded and subsequently blended in a draw frame to obtain each sliver of the base material. In an embodiment of the present invention, the linear density or fineness of the base material sliver may be 0.05 hank and above. Each of the base material sliver may be subjected to combing to remove short fibers. The linear density of the sliver base material sliver ranges from 0.120 to 0.90 after combing. The amount of noil, which is fibers that are less than a predefined length preferably 12 mm are removed. The weight of the noil may range from 7% to 24% of the weight of the feed material. The cut length of each of the plurality of base material fibers is selected substantially equivalent to the cut length of each of the plurality of water soluble material fiber. In an embodiment of the present invention, the cut length of each of the base material fiber ranges between 28 mm to 32 mm. In a preferred embodiment of the present invention, the cut length of each of the base material fibers is substantially around 32 mm.

In an embodiment of the present invention, the blending of one or more slivers of water soluble material with the one or more slivers of base material is performed in a draw frame using a first set of parameters. In particular, the blending of one or more slivers of water soluble material with the one or more slivers of base material is performed in a breaker draw frame using a first set of parameters. In an embodiment of the present invention the first set of parameters include, but are not limited to, a break draft range of 1.3 to 2; a main draft range of 5-8; total draft range of 8.5 to 9; Wrapping (Wpg) in the range of 5-6 grams per meter (g/m); diameter of three bottom rollers associated with the draw frame as 30 mm, 30 mm and 40 mm respectively; diameter of three top rollers associated with the draw frame as 38 mm, 38 mm and 38 mm respectively; cots hardness (rubber coating of the top three rollers) in the range of 70-72 shore, top roll load of 20 kg/cm$^2$ and delivery speed of breaker draw frame in the range 250-350 meter per min (mpm). In a preferred embodiment of the present invention, the break draft is 1.7; main draft is 5; total draft is 8.5 and Wrapping (Wpg) is 5.9 g/m. As shown, in FIG. 3*a*, the input of the breaker draw frame is one or more slivers of water soluble material and one or more slivers of base material. Further, the fibers of water soluble material within the one or more slivers of water soluble material are represented by grey color and the fibers of base material within the one or more slivers of base material are represented by black color exhibiting no orientation. The first set of parameters along with length equalization of water soluble material fibers and base material fibers cause the one or more slivers of the water soluble material to extend longitudinally along a center of each of the plurality of blended slivers and the one or more slivers of base material to surround the one or more slivers of the water soluble material.

Figure 3:
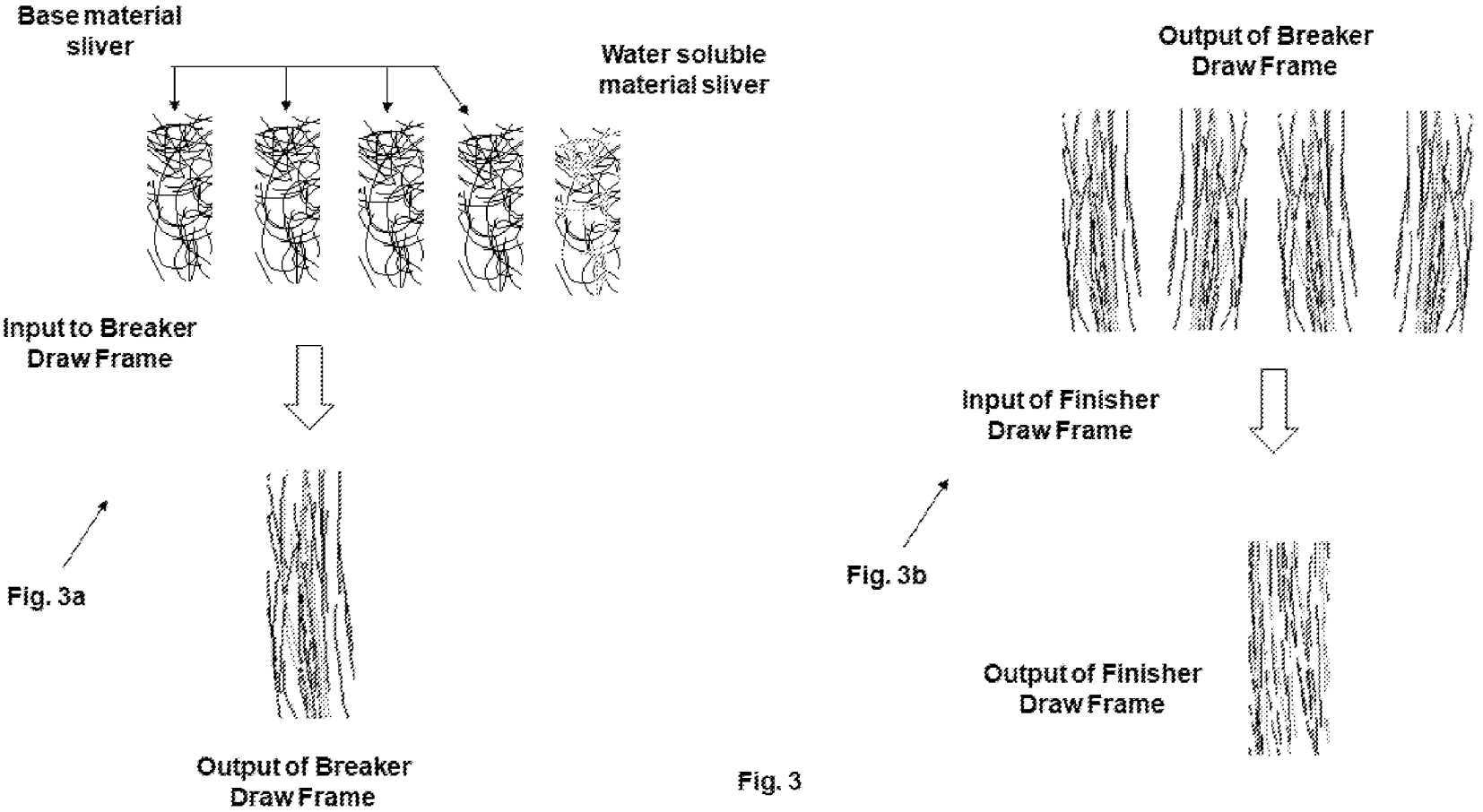
FIGS. 3*a*, 3*b*, 3*c* and 3*d* illustrates a controlled movement of fibers of water soluble material and fibers of base material during various process steps as illustrated in FIG. 2, in accordance with various embodiments of the present invention.

At step 204, a homogenously blended sliver is obtained by doubling the plurality of blended slivers using a second set of parameters. In an embodiment of the present invention, each of the plurality of blended slivers comprises the one or more slivers of water soluble material and one or more slivers of base material. The plurality of blended fibers are further fed as an input to a finisher draw frame. Further, the plurality of blended slivers are doubled in the finisher draw frame using a second set of parameters to obtain the homogenously blended sliver as illustrated in FIG. 3*b*. The homogenously blended sliver comprises a plurality of fibers of water soluble material and plurality of fibers of base material. As illustrated in FIG. 3*b*, the second set of parameters cause the plurality of fibers of water soluble material and the plurality fibers of the base material to distribute radially and homogenously across a cross-section of the homogenously blended sliver. In an embodiment of the present invention, the diameter or fineness of the homogenously blended sliver ranges from 0.05 to 0.40 hanks. In an exemplary embodiment of the present invention, the fineness of the homogenously blended yarn is 0.12 hanks.

In an embodiment of the present invention the second set of parameters include, but are not limited to, a break draft range of 1.13 to 2.2; a main draft range of 4.7 to 9.1; total draft range of 8-8.5; Wrapping (Wpg) in the range of 4.9-6.5 g/m; diameter of three bottom rollers associated with the finisher draw frame as 30, 30 and 40 mm respectively; diameter of three top rollers associated with the finisher draw frame as 38, 38 and 38 mm respectively; cots hardness (rubber coating of the top three rollers) in the range of 68-70 shore, top roll load in the range of 30-32 kg/cm$^2$ and delivery speed of finisher draw frame in the range 350-400 meter per minute (mpm). In a preferred embodiment of the present invention, the break draft is 1.28; main draft is 6.25; total draft is 8 and wrapping (Wpg) is 0.09 hank.

At step 206, a roving is obtained by drafting the homogenously blended sliver using a third set of parameters. In various embodiments of the present invention, the homogenously blended sliver from the finisher draw frame is fed into a roving frame, also known as the speed frame. In the roving frame, the roving is obtained by reducing the linear density of the homogenous blended sliver by drafting using a third set of parameters. As shown in FIG. 3*c*, the homogenous blended slivers comprising the plurality of slivers of water soluble material are drafted into the roving. The third set of parameters cause the plurality of fibers of water soluble material and the plurality of fibers of base material to distribute radially and homogenously across a cross-section of the roving as illustrated in FIG. 3*c*. In an embodiment of the present invention the third set of parameters include, but are not limited to, a break draft range of 1.05 to 1.2; a main draft range of 4.5 to 7.14; total draft range of 5.7-6.0; Wrapping (Wpg) in the range of 0.45-0.65 hank; diameter of three bottom rollers associated with the roving frame as 28, 28 and 28 mm respectively; diameter of three top rollers associated with the roving frame as 29, 29 and 29 mm respectively; cots hardness (rubber coating of the top three rollers) in the range of 68-70 shore, top roll load in the range of 20-22 kg/cm$^2$ and delivery speed in the range 900-1000 rotation per minute (rpm). In a preferred embodiment of the present invention, the break draft is 1.05; main draft is 5.5; total draft is 5.775 and wrapping (Wpg) is 0.55 hank.

The preparation of the roving in the roving frame further includes slight twisting of the roving, which is also referred to as pre-spinning. In an exemplary embodiment of the present invention, the roving is twisted in the clockwise direction to obtain a 7' twist. Alternatively, the roving can be twisted in a counter-clockwise direction to obtain an 'S' twist. The twist imparted on the roving with a selected twist multiplier (TM) further causes interlinking of a fraction of the plurality of fibers of water soluble material. In an exemplary embodiment of the present invention, the twist multiplier is 1.27 and the twist per inch (TPI) is 0.93. In an exemplary embodiment of the present invention, the roving obtained as an output of the roving frame have linear density ranging from 0.45 to 0.65 hanks.

At step 208, a spun yarn is obtained by spinning the roving using a fourth set of parameters. In an embodiment of the present invention, the roving obtained as an output of the roving frame is fed as an input to a ring frame. The roving is spun in the ring frame using a fourth set of parameters to obtain a yarn having a twist multiplier in the range of 3.2 to 3.8. As illustrated in FIG. 3*d*, the fourth set of parameters cause the plurality of fibers of water soluble material and the plurality of fibers of base material comprised by the roving to interlink and distribute radially and homogenously across a cross-section of the yarn. In an embodiment of the present invention the fourth set of parameters include, but are not limited to, a break draft range of 1.14 to 1.41; a main draft range of 11.3 to 36.7; a total draft range of 14.5-47; diameter of three bottom rollers associated with the ring frame as 28 mm, 28 mm and 28 mm respectively; diameter of three top rollers associated with the ring frame as 29 mm, 28 mm and 29 mm respectively; cots hardness (rubber coating of the top three rollers) in the range of 64-67 and top roll load in the range of 18-19 kg/cm$^2$. In a preferred embodiment of the present invention, the break draft is 1.28; main draft is 21.8 and total draft is 27.904. The yarn obtained from the ring frame has a count ranging from 8 Ne to 26 Ne. In an embodiment of the present invention, deviation of parameter values from the provided range may cause unwanted re-arrangement of fibers due to high draft speed.

In another embodiment of the present invention, the spun yarn obtained from the roving may be doubled. Doubling may be used to obtain two or more ply yarn. In an exemplary embodiment of the present invention, two spun yarns may be doubled on two-for-one twisters with a twists per inch (TPI) ranging from about 5.5 to 16.5 in 'S' direction. In another exemplary embodiment of the present invention, the twist direction can be Z over S or Z over Z. The resultant counts would be about 2/7 s to about 2/32 s, for terry fabrics.

In an embodiment of the present invention, the ring spun yarn is wound into large packages using a winding machine. In an exemplary embodiment of the present invention, the ring spun yarn is wound using autoconer winding machine.

At step 210, an Air rich yarn is obtained from the spun yarn of step 208 by dissolving water soluble material fibers. In an embodiment of the present invention, the spun yarn is treated with water. Treatment with water dissolves the water soluble material within the spun yarn. In an embodiment of the present invention temperature of water ranges from 40° C. to 110° C. depending on the water soluble material fiber. In a preferred embodiment of the present invention, the water soluble fiber is PVA fiber of 32 mm cut length and the water temperature ranges from 80° C. to 90° C. In an exemplary embodiment of the present invention treatment with water includes washing the yarn in acidic conditions with liquor for 10 to 20 minutes. Optionally, in another embodiment of the present invention, the spun yarn may be dyed to obtain an air rich yarn of desired colors. The PVA fibers of the spun yarn may be dissolved as explained above before the yarn dyeing process. Finally the air rich yarn comprising the plurality of interlinked through-pores distributed homogenously across the cross-section of said yarn is obtained. The plurality of interlinked through-pores are representative of pores that open to the surface of the yarn. The through-pores provide fluid passage way from the surface of the yarn into pore spaces and provide improved absorption and dry-ability.

In another embodiment of the present invention, the spun yarn may be manufactured by feeding the homogenously blended sliver obtained by doubling the plurality of blended slivers at step 204 as an input to an Open end [OE] spinning machine. The output of the OE machine provides the spun yarn comprising a plurality of fibers of water soluble material and a plurality of fibers of base material to interlink and distribute radially and homogenously across a cross-section of the yarn. The air-rich yarn may be obtained from the spun yarn as already explained in step 210.

Advantageously, in accordance with various embodiments of the present invention, the first, second, third and fourth set of parameters causes the controlled movement of the plurality of fibers of water soluble material and plurality of fibers of base material which results in a significant improvement in the fiber arrangement through the various stages of spinning. It has been observed that an unexpected result is achieved in terms of the interlinking and eventual through-pores that are formed in the manufactured yarn. It is to be understood, that the controlled movement of fibers is highly essential for achieving homogenous blending, interlinking and homogeneous distribution of the through-pores across the cross-section of the yarn. The controlled movement requires precise computations and optimization of parameters such as fiber length, draft force, drafting roller type and dimensions associated with the rollers, as has been demonstrated in accordance with various embodiments of the present invention, which has been obtained through extensive experimentation and application of inventive skill.

Figure 4:
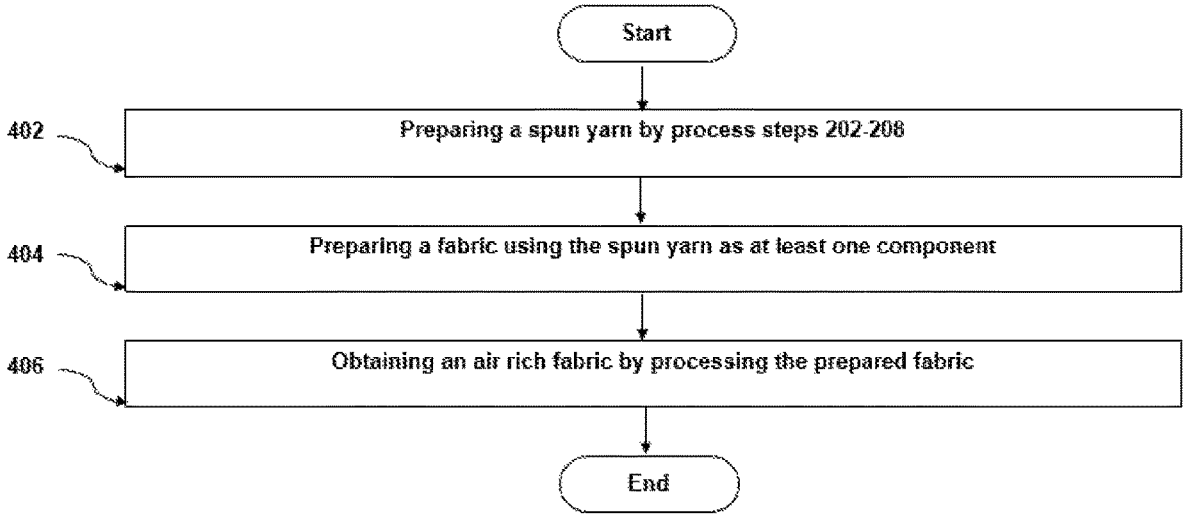
FIG. 4 is a flow chart illustrating an improved process for manufacturing an air rich fabric, in accordance with various embodiments of the present invention.

FIG. 4 is a flow chart illustrating a process for manufacturing an air rich fabric, in accordance with various embodiments of the present invention. Referring to FIG. 4, at step 402, a spun yarn is prepared via spinning. In various embodiments of the present invention, the process of spinning includes preparing a spun yarn using the steps (202 to 208) of FIG. 2 as described above. In another embodiment of the present invention, the process of spinning includes obtaining the spun yarn from OE spinning machine. The prepared yarn comprises a plurality of slivers of water soluble material interlinked and distributed radially and homogenously across the cross-section of the yarn (As described at step 208). The prepared yarn has a count ranging from 8 Ne to 26 Ne and a twist multiplier in the range of 3.2 to 3.8.

At step 404, a fabric is prepared using the manufactured spun yarn as at least one component. In various embodiments of the present invention, a fabric is prepared using the spun yarn as at least one of the components via weaving or knitting. In an embodiment of the present invention, the fabric is prepared by weaving. The process of weaving includes interweaving a plurality of warp yarns with a plurality of weft yarns using one or more weaving patterns to achieve a fabric. The thread count of the fabric is in the range of 8 s to 30 s for terry towels and 20 s to 100 s for flat fabric. The spun yarn may be used as a weft yarn or a warp yarn. In an exemplary embodiment of the present invention, the spun yarn (of step 402) is used as a warp yarn. The weft yarn may be selected from, but is not limited to, polyester, modal, lyocell and cotton; blends of polyester & viscose; blends of cotton and modal; blends of cotton and silk and modal; blends of cotton and bamboo; blends of cotton and sea weed fibers; blends of cotton and silver fibers; blends of cotton and charcoal fibers, and any combinations thereof. The weft yarn may have a count ranging from 3 s to 60 s. In an exemplary embodiment of the present invention, ratio of the spun yarn as warp to a weft of other material is 4:7. In an exemplary embodiment of the present invention, ratio of spun yarn as pile yarn to warp and weft of other material is 2.5-10.

In an exemplary embodiment of the present invention, a terry fabric is woven from the spun yarn as one of the components. The spun yarn may be used as a pile warp, ground warp or weft. In a preferred embodiment of the present invention, the spun yarn (step 402) is used as a pile warp. The yarn may have single count in the range of 8 Ne to 26 Ne or double count in the range of Ne 2/16 s to about Ne 2/30 s. In an exemplary embodiment of the present invention, the twist multiplier (TM) for the spun yarn ranges from 3.2 to 3.8 for single count. The twist per inch (TPI) for the spun yarn of double count ranges from 4.3 to 16.

In an exemplary embodiment of the present invention, the ground warp and weft yarn may be cotton. The cotton may be selected from, but not limited to Egyptian cotton, Australian cotton, American cotton, Syrian cotton, or Russian cotton. In an exemplary embodiment of the present invention, the terry fabric is made on 56 s, 60 s and 70 s reeds; however, reed is not a limiting factor. The terry weave may be a 3 pick terry, 4 pick terry, 5 pick terry or a 6 pick terry. In an exemplary embodiment of the present invention, the pile height may be in the range of 2.5 mm to 10 mm. in another embodiment of the present invention, the pile height may be in the range of 4 mm to 6.5 mm.

In another embodiment of the present invention, the flat fabric may be woven from the prepared yarn. The prepared yarn may be used as a weft yarn or a warp yarn. In an exemplary embodiment of the present invention, the prepared yarn is used as a warp yarn. The weft yarn may be selected from, but is not limited to, polyester and cotton; blends of polyester & viscose; blends of cotton and modal; blends of cotton and silk and modal; blends of cotton and bamboo; blends of cotton and sea weed fibers; blends of cotton and silver fibers; blends of cotton and charcoal fibers, and any combinations thereof. In an exemplary embodiment of the present invention, the weft yarn may be cotton. The cotton may be selected from, but not limited to Egyptian cotton, Australian cotton, American cotton, Syrian cotton, or Russian cotton. Additionally, the construction of a flat fabric depends on the end use and type of fabric to be made.

At step 406, air rich fabric is obtained by processing the fabric produced at step 404. In various embodiment of the present invention, the fabric is processed. The processing of fabric includes pre-treatment with water, singeing, de-sizing, scouring, bleaching, dyeing, finishing and drying. In an embodiment of the present invention, pretreatment with water includes washing the produced fabric with water in acidic conditions to dissolve the water soluble material slivers in the yarn of the fabric. The temperature of water is selected based on the properties of the water soluble material. In an exemplary embodiment of the present invention, the acidic conditions exhibiting a pH ranging from, but not limited to, 5.5 to 6.5 is achieved by addition of acid liquor in the water. Example of acid liquor includes, but is not limited to, acetic acid. In an exemplary embodiment of the present invention, where the water soluble material is PVA, the temperature of water for dissolving PVA slivers ranges from 40° C. to 110° C. In a preferred embodiment of the present invention, where the PVA is of 32 mm cut length the temperature of water ranges from 80° C. to 110° C. Subsequent to washing of the fabric, PVA residue and liquor are drained. Thereafter, the fabric is treated with fresh water at 110° C. for scouring and bleaching process, ensuring removal of residual traces of PVA fibers from the fabric. The washed fabric may be dried via hydro extractor, rope opener, loop dryer or a stenter.

The dissolution of PVA fibers within the yarns creates a plurality of interlinked through-pores which are distributed homogenously across the cross-section of said yarn. Thereby, an Air rich fabric is produced comprising through-pores throughout cross-section of the yarn used in the fabric. In an exemplary embodiment of the present invention, the amount of water soluble material fibers present in the fabric may be in the range of 5% to 25% of the weight of the yarn. The Air rich yarn of the present invention, exhibits enhanced softness, absorbency, better wettability, higher thickness, improved drying, and bulk in comparison to standard cotton fabric. Subsequently, the Air rich fabric may be scoured, bleached, dyed and finished.

Optionally, the water soluble material slivers may be dissolved at the time of fabric dyeing. In an exemplary embodiment of the present invention, the fabric is dyed using a batch dyeing process. The liquor ratio should be selected so as to facilitate prompt dissolution of the PVA, while allowing free movement of the fabric. In an exemplary embodiment of the present invention, the liquor ratio ranges from 1:5 to 1:30. In the preferred embodiment of the present invention, the liquor ratio is 1:5 which is considered as lowest in exhaust batch dyeing process in soft flow machines. In an exemplary embodiment of the present invention, the dyeing ratio is 1:20 if dyeing is carried out in winch or Jigger machines.

Subsequent to drying, the fabric may be dried via one of: hydro extractor, rope opener, loop dryer and stenter.

Advantageously, in accordance with various embodiments of the present invention, the Air rich yarns and Air rich fabric manufactured by the improved process of the present invention, exhibit high absorbency and can absorb around 75% and 100% of the water contacting the yarn or fabric (Amount of water as per Test Method ASTM D4772). The porous Air rich yarns and fabrics are 30 to 40% more voluminous than the standard cotton fabrics and have 20 to 30% higher thermal insulation properties. Additionally, the air rich yarns and air rich fabrics of the present invention have increased dry-ability and may dry at a rate which is 10 to 30% faster than the normal yarn or fabric.

While the exemplary embodiments of the present invention are described and illustrated herein, it will be appreciated that they are merely illustrative. It will be understood by those skilled in the art that various modifications in form and detail may be made therein without departing from or offending the spirit and scope of the invention.

We claim:

1. A process for manufacturing a yarn, said process comprising:

preparing a plurality of blended slivers, wherein each of the plurality of blended slivers are prepared by blending one or more slivers of a water soluble material with one or more slivers of a base material;

doubling the plurality of blended slivers to obtain a homogenously blended sliver such that a plurality of fibers of the water soluble material in each of the one or more slivers of the water soluble material and a plurality of fibers of the base material in each of the one or more slivers of the base material distribute radially and homogenously across a cross-section of the homogenously blended sliver;

drafting the homogenously blended sliver to obtain a roving such that the plurality of fibers of the water soluble material and the plurality of fibers of the base material distribute radially and homogenously across a cross-section of the roving, wherein at least the plurality of fibers of the water soluble material are caused to be interlinked; and spinning the roving such that the plurality of fibers of the water soluble material and the plurality of fibers of the base material interlink and distribute radially and homogenously across a cross-section of the spun yarn, wherein further the water soluble material fibers are dissolved by treating with water to obtain the yarn comprising the plurality of interlinked through-pores distributed homogenously across the cross-section of the yarn.

2. The process as claimed in claim 1, wherein said process comprises:

preparing the plurality of blended slivers, wherein each of the plurality of blended slivers are prepared by blending one or more slivers of the water soluble material with one or more slivers of the base material using a first set of parameters for optimized blending, further wherein a cut length of staple water soluble fibers and staple base material fibers for preparing each sliver of the water soluble material and each sliver of the base material, respectively, is substantially equal such that the one or more fibers of the water soluble material extend longitudinally along a length of each of the plurality of blended slivers;

doubling the plurality of blended slivers using a second set of parameters to obtain the homogenously blended sliver such that the plurality of fibers of the water soluble material in each of the one or more slivers of the water soluble material distribute radially and homogenously across a cross-section of the homogenously blended sliver;

drafting the homogenously blended sliver using a third set of parameters to obtain the roving such that the plurality of fibers of the water soluble material distribute radially and homogenously across the cross-section of the roving and wherein further at least a fraction of the plurality of fibers of the water soluble material are caused to be interlinked; and spinning the roving using a fourth set of parameters to obtain the spun yarn having a twist multiplier in the range of 3.2 to 3.8 such that the plurality of fibers of the water soluble material interlink and distribute radially and homogenously across the cross-section of the spun yarn, wherein further the water soluble material fibers are dissolved by treating with water to obtain the yarn comprising the plurality of interlinked through-pores distributed homogenously across the cross-section of the yarn.

3. The process as claimed in claim 1, wherein preparing each of the one or more slivers of the water soluble material comprises processing a plurality of staple fibers of water soluble material in a blow room system or a draw frame.

4. The process as claimed in claim 1, wherein the water soluble material is polyvinyl alcohol.

5. The process as claimed in claim 3, wherein processing the plurality of staple fibers of the water soluble material further includes opening, cleaning, carding, blending and leveling of the plurality of staple fibers of the water soluble material.

6. The process as claimed in claim 3, wherein the linear mass density of each of the water soluble material fibers is in the range of 1.2 to 2.2 denier (D).

7. The process as claimed in claim 3, wherein the cut length of each of the water soluble material fibers is in the range of 30 mm to 38 mm.

8. The process as claimed in claim 2, wherein the cut length of each of the water soluble material fiber is 32 mm.

9. The process as claimed in claim 1, wherein a linear density of each of the one or more water soluble material sliver ranges between 0.05 hank and 0.15 hank.

10. The process as claimed in claim 1, wherein the base material is selected from a group consisting of: cotton blends, greige cotton, dyed cotton, cleaned cotton, silk fibers, modal fibers, lyocell, greige or dyed acrylic fibers, greige or dyed polyester, polybutylene terephthalate (PBT), recycled polyester, polytrimethylene terephthalate (PTT), any other cellulose based stable fiber, blends of cotton and bamboo, blends of cotton and sea weed fibers, blends of cotton and lyocell fibers, and blends of cotton and charcoal fibers.

11. The process as claimed in claim 1, wherein preparing each of the one or more slivers of the base material comprises: processing a plurality of staple fibers of the base material in a blow room system, carding the processed fibers of the base material and blending the carded fibers in a draw frame.

12. The process as claimed in claim 11, wherein each of the one or more base material slivers are combed to remove short fibers.

13. The process as claimed in claim 11, wherein a cut length of each of the plurality of base material fibers is in range of 28 mm to 32 mm.

14. The process as claimed in claim 2, wherein a cut length of each of the base material fibers is 32 mm.

15. The process as claimed in claim 1, wherein a linear density of the base material sliver is equal to or greater than 0.05 hank.

16. The process as claimed in claim 1, wherein the blending of the one or more slivers of water soluble material and the one or more slivers of base material is performed in a breaker draw frame using a first set of parameters, wherein the first set of parameters include a break draft range of 1.3 to 2; a main draft range of 5-8; total draft range of 8.5 to 9; wrapping in the range of 5-6 grams per meter (g/m); diameter of three bottom rollers associated with the draw frame as 30 mm, 30 mm and 40 mm respectively; diameter of three top rollers associated with the draw frame as 38 mm, 38 mm and 38 mm respectively; cots hardness in the range of 70-72 shore, top roll load of 20 kg/cm$^2$ and delivery speed of breaker draw frame in the range 250-350 meter per min (mpm).

17. The process as claimed in claim 1, wherein the doubling of the plurality of blended slivers is performed in a finisher draw frame using a second set of parameters, wherein the second set of parameters includes a break draft range of 1.13 to 2.2; a main draft range of 4.7 to 9.1; total draft range of 8-8.5; wrapping in the range of 4.9-6.5 g/m; diameter of three bottom rollers associated with the finisher draw frame as 30 mm, 30 mm and 40 mm respectively; diameter of three top rollers associated with the finisher draw frame as 38 mm, 38 mm and 38 mm respectively; cots hardness in the range of 68-70 shore, top roll load in the range of 30-32 kg/cm$^2$ and delivery speed of finisher draw frame in the range 350-400 meter per minute (mpm).

18. The process as claimed in claim 1, wherein the homogenously blended sliver is drafted in a roving frame using a third set of parameters, wherein the third set of parameters include a break draft range of 1.05 to 1.2; a main draft range of 4.5 to 7.14; total draft range of 5.7-6.0; wrapping in the range of 0.45-0.65 hank; diameter of three bottom rollers associated with the roving frame as 28 mm, 28 mm and 28 mm respectively; diameter of three top rollers associated with the roving frame as 29 mm, 29 mm and 29 mm respectively; cots hardness in the range of 68-70 shore, top roll load in the range of 20-22 kg/cm$^2$ and delivery speed in the range 900-1000 rotation per minute (rpm).

19. The process as claimed in claim 1, wherein the roving is twisted in clockwise direction to obtain a twist in S or Z direction.

20. The process as claimed in claim 1, wherein a linear density of the obtained roving ranges from 0.45 to 0.65 hanks.

21. The process as claimed in claim 1, wherein the roving is spun in a ring frame using a fourth set of parameters, wherein the fourth set of parameters include a break draft range of 1.14 to 1.41; a main draft range of 11.3 to 36.7; a total draft range of 14.5-47; diameter of three bottom rollers associated with the ring frame as 28 mm, 28 mm and 28 mm respectively; diameter of three top rollers associated with the ring frame as 29 mm, 28 mm and 29 mm respectively; cots hardness in the range of 64-67 and top roll load in the range of 18-19 kg/cm$^2$.

22. The process as claimed in claim 1, wherein a count of the obtained yarn ranges from 8 Ne to 26 Ne.

23. The process as claimed in claim 21, wherein the spun yarn is doubled on two-for-one twisters with a twists per inch (TPI) ranging from about 5.5 to 16.5 in one of: 'S' direction, Z direction, Z over S or Z over Z direction.

24. The process as claimed in claim 1, wherein the water soluble material is dissolved by treating the spun yarn with water in acidic condition, wherein a temperature of water ranges from 40° C. to 110° C.

25. A process for manufacturing a fabric, said process comprising:

preparing a plurality of blended slivers, wherein each of the plurality of blended slivers are prepared by blending one or more slivers of a water soluble material with one or more slivers of a base material;

doubling the plurality of blended slivers to obtain a homogenously blended sliver such that a plurality of fibers of the water soluble material in each of the one or more slivers of the water soluble material and a plurality of fibers of the base material in each of the one or more slivers of the base material distribute radially and homogenously across a cross-section of the homogenously blended sliver;

drafting the homogenously blended sliver to obtain a roving such that the plurality of fibers of the water soluble material and the plurality of fibers of the base material distribute radially and homogenously across a cross-section of the roving, wherein at least the plurality of fibers of the water soluble material are caused to be interlinked; and spinning the roving such that the plurality of fibers of the water soluble material and the plurality of fibers of the base material interlink and distribute radially and homogenously across a cross-section of the spun yarn;

preparing a fabric using the spun yarn as at least one component; and processing the prepared fabric, wherein processing includes treatment with water and dyeing, wherein further treatment with water and dyeing dissolves the water soluble material in the spun yarn to provide the plurality of interlinked through-pores distributed homogenously across the cross-section of the spun yarn.

26. The process as claimed in claim 25, wherein the process comprises:

preparing the plurality of blended slivers, wherein each of the plurality of blended slivers are prepared by blending one or more slivers of the water soluble material with one or more slivers of the base material using a first set of parameters for optimized blending, further wherein a cut length of staple water soluble fibers and staple base material fibers for preparing each sliver of the water soluble material and each sliver of the base material respectively, is substantially equal, such that the one or more slivers of the water soluble material extend longitudinally along a center of each of the plurality of blended slivers;

doubling the plurality of blended slivers using a second set of parameters to obtain the homogenously blended sliver such that the plurality of fibers of the water soluble material included in each of the one or more slivers of the water soluble material distribute radially and homogenously across a cross-section of the homogenously blended sliver;

drafting the homogenously blended sliver using a third set of parameters to obtain the roving, such that the plurality of fibers of the water soluble material distribute radially and homogenously across a cross-section of the roving and wherein further at least a fraction of the plurality of fibers of the water soluble material are caused to be interlinked; and spinning the roving using a fourth set of parameters to obtain the spun yarn having a twist multiplier in the range of 3.2 to 3.8, such that the plurality of fibers of the water soluble material interlink and distribute radially and homogenously across a cross-section of the spun yarn, preparing the fabric using the spun yarn as at least one component; and processing the prepared fabric, wherein processing includes treatment with water and dyeing, wherein further treatment with water and dyeing dissolves the water soluble material in the spun yarn to provide the plurality of interlinked through-pores distributed homogenously across the cross-section of the spun yarn.

27. The process as claimed in claim 25, wherein the fabric is prepared by weaving or knitting.

28. The process as claimed in claim 27, wherein the fabric is prepared by weaving and the spun yarn is used as at least one of: a pile warp, a ground warp and a weft.

* * * * *